United States Patent [19]

With

[11] 3,933,364

[45] Jan. 20, 1976

[54] SKI POLE

[76] Inventor: Bror With, Jarlsborgveien 1, Oslo 3, Norway

[22] Filed: July 10, 1972

[21] Appl. No.: 270,513

[52] U.S. Cl. ..... 280/11.37 D
[51] Int. Cl.[2] ..... A63C 11/22
[58] Field of Search... 280/11.37 B, 11.37 D, 11.37 H, 280/11.37 L, 11.37 F, 11.37 N, 11.37 Z, 11.37 P, 11.37 R

[56] References Cited

UNITED STATES PATENTS

| | | | |
|---|---|---|---|
| 2,741,485 | 4/1956 | Storm et al. | 280/11.37 B |
| 3,113,786 | 12/1963 | Phillipson | 280/11.37 H |

FOREIGN PATENTS OR APPLICATIONS

| | | | |
|---|---|---|---|
| 242,862 | 11/1946 | Switzerland | 280/11.37 L |
| 94,719 | 9/1959 | Norway | 280/11.37 H |
| 186,208 | 12/1963 | Sweden | 280/11.37 H |

*Primary Examiner*—M. Henson Wood, Jr.
*Assistant Examiner*—Milton L. Smith

[57] ABSTRACT

In a ski pole having a tubular rod it is proposed to make up the rod of a central metal tube and end portions of plastic having lower module of elasticity, heat conductivity and density. The metal rod terminates short of the disc and of the handle. The upper end portion is hollow and expands upward so as to form a hollow handle receiving the ends of the hand strap, one of which ends is adjustable. The lower end portion, which likewise is hollow, is shaped with abutments for the disc boss and is narrowed at the bottom so as to receive the spike.

7 Claims, 3 Drawing Figures

SKI POLE

BACKGROUND OF THE INVENTION

Figure 1:
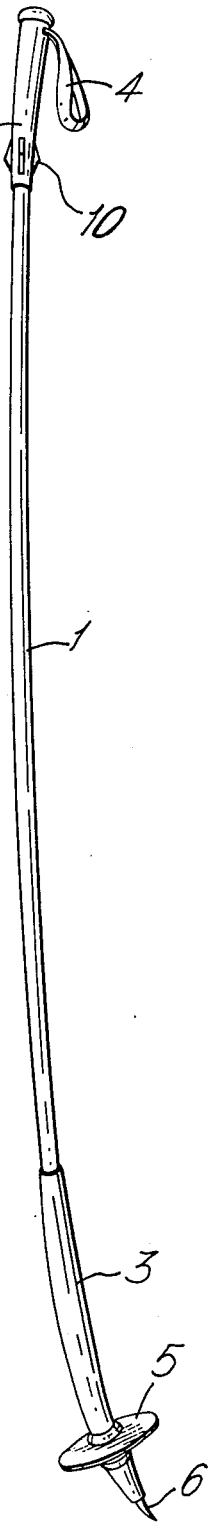

The invention relates to ski poles, and a main object of the invention is to make it possible with manufactured materials to make ski poles which are really well suited for race and cross-country skiing and hence can compare in this respect with the Ton-kin rods commonly used at present.

Whereas metal tube poles are dominating in alpine skiing, they have had no success as far as race and cross-country skiing is concerned. There are several reasons for this. An important reason is that metal poles have a much too quick rebound and therefore feel hard and in the long run are tiring for the arm and the hand. Besides, they cause uncomfortable chinking, so that they sound and sing just up into the ear for each step on icy snow.

Attempts have been made with glass-reinforced plastics as materials for ski poles, but here difficulties have been encountered with respect to combining light weight and correct resiliency on the one hand and satisfactory mechanical strength on the other.

Further, attempts have been made for improving the mechanical properties of metal poles by making the metal tube with a crosssection decreasing towards both ends from a thicker central portion, so as better to withstand buckling stresses while at the same time having somewhat more flexible end portions. However, this is by far not sufficient for eliminating the drawbacks set out above and, besides, entails the risk of breaking of the pole in the vicinity of the disc when it gets stuck in crust or packed snow.

The consequence has therefore been that the natural materials a bamboo and Ton-kin are still the dominating materials for poles for race and cross-country skiing. However, in view of the intensive expansion that is at present taking place in both these sport branches it cannot be expected that the supply of these materials will be sufficient for covering the demand in the long run, so that there exists a pronounced demand for finding satisfactory substitutes.

SUMMARY OF THE INVENTION

The present invention aims at eliminating the existing drawbacks, and in particular those referred to above, in ski poles of manufactured materials. The present pole has a rod which for a substantial part consists of a relatively rigid material, such as metal, and like the metal poles with varying cross-section referred to above, it is more rigid in the central portion than at one or both ends. The pole according to the invention is primarily characterized in that the relatively rigid tube at least at one end terminates short of the corresponding ends of the part of the rod extending between handle and disc, and is extended by a portion of a material having a lower module of elasticity, such as a suitable plastic. It is thereby possible to combine the strength qualities of a metal rod, especially the buckling strength, with the desired properties with respect to resiliency, sound insulation etc., due to the more flexible end portions, so that it is possible to arrive at a very light pole which is both efficient and convenient and at the same time more safe against breaking than those commonly used today. The tube in the central portion may conveniently consist of spring-hard metal and may with a view to reduction of weight and to buckling strength taper towards the ends in known manner, so as more evenly to distribute the flexing. At the same time the softer material in one or both end portions will have a slower and hence more convenient rebound, so that it will be possible to attenuate and adapt the resiliency of the pole in good harmony with the rhytmus of the arm.

An additional advantage to making the lower end portion of the pole consist of a relatively soft material consists in that this portion will be capable of flexing and hence of escaping instead of breaking when the pole is forced down into crust or packed snow during downhill skiing. Further, plastic materials suitable for the purpose have a considerably lower density than those used in metal poles, so that the moment of interia will be reduced, in spite of the fact that greater wall thicknesses will be needed in the softer end portions than in the metal tube.

Even for the upper end portion of the rod the use of moldable plastics can be utilized for achieving further advantages. Thus, plastic materials suitable for the purpose will have a considerably lower heat conductivity than the metal rod, and when this portion is also made hollow to save weight, the hand will therefore be cooled off much less than in the case of usual handles surrounding a metal tube. Further, by making the end portion of the pole with crosssectional dimensions sufficiently great for forming the handle, there will be sufficient room inside it for receiving the free ends of the hand strap, which can be made use of for easy mounting and, if desired, also for length adjustment of the strap, which will be illustrated more in detail by an example.

As regards the connection between the softer end portions and the metal tube, the same can easily be effected by a shrinking operation. In the softer lower end portion the spike may be fastened directly either by molding the plastic around it, or by forcing it into a suitably narrow opening. Likewise, this portion may have shoulders as abutments for the disc, while permitting the same to be threaded directly into position.

Figure 2:
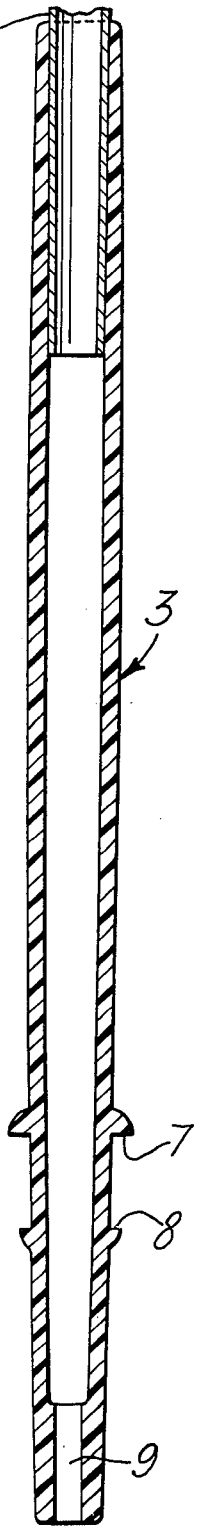
Figure 3:
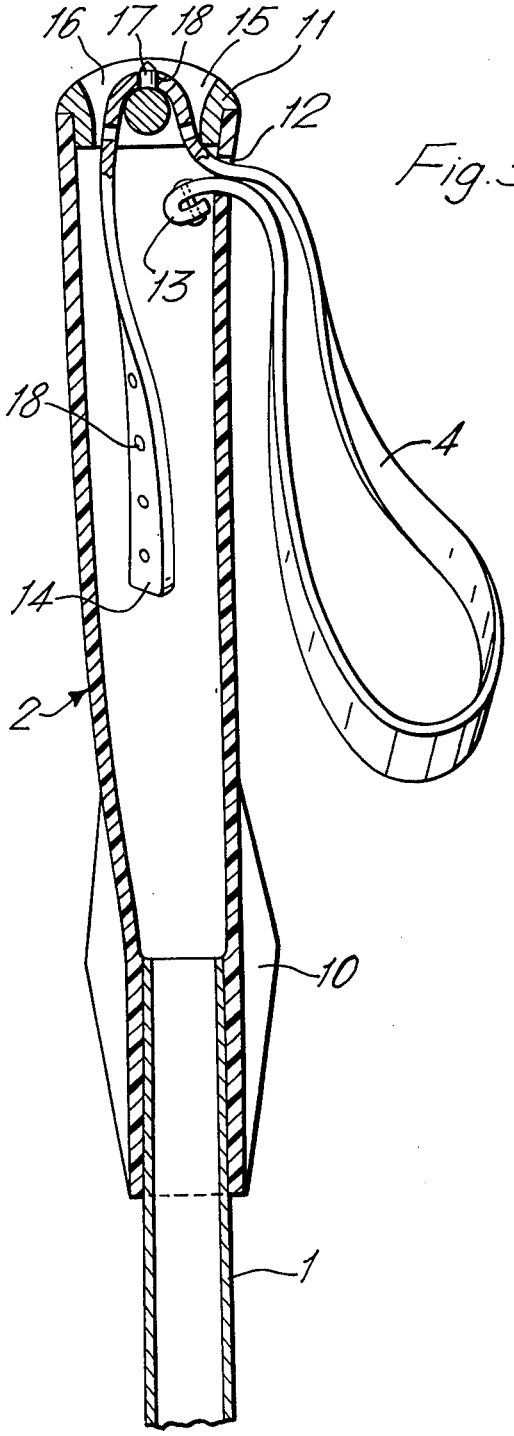

As an example a preferred embodiment of the ski pole according to the invention is illustrated in the accompanying drawing, wherein FIG. 1 is a sketch of the pole at a small scale;

FIG. 2 is a view in axial section of the softer lower end portion of the rod mounted on the adjacent end of the metal tube; and FIG. 3 is a corresponding view in axial section of the upper end portion of the pole with the hand strap attached.

In the drawing, 1 designates the metal tube, 2 and 3 the upper and lower end portion, respectively, of the rod, both made of plastic, 4 the hand strap, 5 the disc and 6 the spike. The metal rod 1 — which may conveniently taper towards the ends, although this has not been illustrated clearly since it does not form part of the invention — terminates at the bottom at a distance short of the disc 5 and at the top at a distance short of the part of the end portion 2 to be gripped by the hand when the latter is passed through the hand strap 4. The portions 2 and 3 of plastic are softer than the tube 1, so that under load the pole will be deformed in the manner illustrated with some exaggeration in FIG. 1, as it will flex more at the top and at the bottom than in the middle, irrespective of whether the pole is resting with the pike 6 on hard icy ground or with the disc 5 on crust or snow.

As illustrated in FIG. 2, the lower end portion 3 has an exterior shoulder 7 which is intended to serve as an abutment for the disc boss when the disc 5 is forced onto the rod from its lower end past a conical thickening forming an upwardly facing shoulder 8 for supporting the lower edge of the disc boss. In its lower extremity the space within the tubular end portion 3 is narrowed as shown at 9, so as to grip the spike 6 firmly when the same is forced into it.

As shown in FIG. 3 the upper part of the tubular upper end portion 2 of the rod has increased cross-sectional dimensions suitable for forming the handle. In the area of transition to the tube 1 it is reinforced by ribs 10 on the outer side as to attenuate the variation in resistance to bending.

As further illustrated in FIG. 3 a knob 11 is inserted in the upper end of the end portion 2, and just below the knob the wall of the portion 2 has an opening 12, into which the end portions of the hand strap 4 extend in superposed position. The opening 12 is so narrow as just to give room for the strap ends, so that the lower strap end 13, which at its extremity is bent back and fixed in double condition so as to form a shoulder, is locked inside the opening. The other end portion 14 is passed upwards through an opening 15 and downwards again through an opening 16 in the knob 11, and between these openings the knob has an upwardly projecting pin 17 on which the end portion 14 can be fixed selectively with holes 18 for length adjustment of the loop of the hand strap.

Since in the embodiment shown any pull on the knob 11 from the hand strap 4 will tend to pull it downwards, the knob may be fitted detachably into the portion 2. Thereby the mounting of the hand strap 4 can take place easily with the knob detached, by at first threading the end 13 and thereafter the end 14 of the strap in through the hole 12, then passing the strap end 14 out and in through the openings 15 and 16, respectively, and fixing it on the pin 17, and finally putting it down into the portion 2, whereafter the knob 11 is placed in position.

Although a specific embodiment of the invention has been described and illustrated, it will be understood that many modifications are possible without exceeding the scope of the invention as set out in the claims.

What I claim is:

1. A ski pole comprising a rod having upper and lower end portions with hand strap and disc, wherein a substantial intermediate part of said rod comprises a tube of a material having a high modulus of elasticity, such as metal, at least one end of said rod comprising a portion of a lower modulus of elasticity, such as plastic, connected to the intermediate part at a location spaced from the adjacent one of the hand strap and the disc.

2. A ski pole as claimed in claim 1, wherein the end portion or portions of the rod are likewise tubular and mounted on the outside of the tube.

3. A ski pole as claimed in claim 1, wherein the lower end portion of the rod is hollow and consists of a material having a considerably lower density than the tube and is narrowed at its end so as to form an attachment for the spike and is molded with a shoulder forming an abutment for the disc.

4. A ski pole as claimed in claim 1, wherein the upper end portion of the rod consists of a material with a relatively low heat conductivity and is formed with a integral hollow handle portion with increased cross-section.

5. A ski pole as claimed in claim 4, wherein a portion of the hand strap extends into the handle portion through an opening in its side wall spaced from the terminal edge of the handle and has ends that terminate in the hollow space therein.

6. A ski pole as claimed in claim 5, wherein a knob is placed detachably in the free extremity of the handle portion and formed with two openings, and one of said strap ends extends from the opening in the side wall of the handle upwards through one and downwards through the other opening in the knob, and wherein said knob has an upward projection between said two openings, and the said strap end has adjustment holes for selectively engaging said projection.

7. A ski pole as claimed in claim 5, in which the other strap end is sufficiently thickened in its extremity for being locked within the handle by the insertion of the former strap end through the opening in said side wall.

* * * * *